US006047955A

United States Patent [19]

Cavanagh

[11] Patent Number: 6,047,955

[45] Date of Patent: Apr. 11, 2000

[54] CLAMP RING FOR A MARINE WINCH

[76] Inventor: Paul D. Cavanagh, 254 Middle Rd., Byfield, Mass. 01922

[21] Appl. No.: 09/122,001

[22] Filed: Jul. 24, 1998

[51] Int. Cl.[7] ..... B66D 1/30

[52] U.S. Cl. ..... 254/371

[58] Field of Search ..... 254/344, 342, 254/371

[56] References Cited

U.S. PATENT DOCUMENTS

| | | | |
|---|---|---|---|
| 4,225,118 | 9/1980 | Otteman | 254/371 |
| 4,681,301 | 7/1987 | Rinio | 254/371 |
| 4,815,710 | 3/1989 | Bonassi | 254/371 |
| 5,088,693 | 2/1992 | Brenot | 254/371 |

*Primary Examiner*—Katherine A. Matecki

*Attorney, Agent, or Firm*—Don Halgren

[57] ABSTRACT

The present invention is a marine winch having a tension limiting clamp ring thereon, to permit the safe release of a line or halyard when forces become too great therewith. The winch has a base for attachment to a boat. A central driveshaft is supported on the base. A drum is disposed about the driveshaft. The drum has an upper flange and a lower flange thereon, the drum being arranged to receive a line thereabout. The upper flange has an inner hub disposed about the upper end of the driveshaft. A clamp ring is arranged about the hub, the clamp ring and the upper flange having opposed outer annular surfaces thereon arranged to receive a line therebetween. The clamp ring is movable with respect to the upper flange and the hub to provide a limitable force on a line disposed between the outer annular surfaces of the flange and the clamp ring.

9 Claims, 4 Drawing Sheets

CLAMP RING FOR A MARINE WINCH

BACKGROUND OF THE INVENTION

1. Field of the Invention

The present invention relates to the marine winches of the type utilized on sailboats, and more particularly to an articulable clamp ring on a marine winch to improve handling of lines on a boat.

2. Prior Art

Marine winches are conventionally used to adjust lines or halyards of sailing craft. The marine winch typically comprises a base element mounted at an appropriate location on the deck or surface structure of the craft. A vertically oriented drum is journalled therewithin, and is manually actuated by a crank operated gear train acting upon a central driveshaft. The driveshaft is journalled and fixably connected to a drum, typically by means of a splined shaft connection therewith.

The line or halyard is wrapped about the drum, with one end of the line coming from the sail or load being hauled. The other end of the line, the tail end, is run between the lips of a cramp ring at the upper end of the drum. The line gets pulled tightly within the pulley-like cramp ring and often may get wedged tightly therewithin.

If a sailor were holding the end of the line, and the tension on that line were suddenly increased, as by a sudden wind load on the sails or a like, that sailor's fingers may be caught and pulled into the clamp ring possibly creating a serious injury for that sailor.

It is an object of the present invention, to provide a clamp ring assembly for a marine winch, which overcomes the disadvantages of the prior art.

It is a further object of the present invention, to provide a marine winch assembly, which will minimize the likelihood of any serious injury occurring because of a sudden tension on a line or halyard.

It is yet a further object of the present invention, to provide a marine winch assembly, which never allows tension in the line or halyard, to exceed a certain safe limit.

BRIEF SUMMARY OF THE INVENTION

The present invention involves a marine winch with a tension limiting clamp ring arranged at the top end of the drum, so as to put a limit on the tension of a line or halyard being gripped thereat, by a sailor holding the tail end of the line or halyard. The marine winch comprises a generally circular base plate, which base plate is typically fixed to a deck or other exposed surface of a sailboat. A vertically disposed driveshaft is rotatably supported at a central location on the base plate. The driveshaft has an upper end into which a handle may be affixed to rotate the driveshaft and drum. A plurality of planetary gears is arranged circumferentially about the driveshaft. The gears are enclosed and the driveshaft is engaged within an inner housing. The inner housing is generally circular and is fixedly attached at its rim-like base to the base plate. The housing includes an internal hollow shaft disposed annularly about the driveshaft. A generally cylinderally shaped drum is rotatably supported about the driveshaft. The drum has a bottom flange disposed adjacent to the periphery of the lower portion of the housing end base. The drum has an upper flange fixedly attached thereto. The upper and lower flanges define the upper and lower boundaries for a line or halyard to be wrapped about the drum.

A clamp ring is disposed about an annular hub member that comprises the radially inner portion of the upper flange.

The clamp ring is arranged to be co-axially movable with respect to and is supported on the upper surface of the upper drum flange. A peeler or stripper bar is arranged on the uppermost end of the driveshaft and has radially extended finger over which a line or halyard is fed after wrapping of the line about the drum. The flange hub or annular housing portion of the upper flange has an uppermost end on which the peeler bar is rotatably supported. The hub of the upper flange has an annular groove arranged at a spaced distance from its uppermost end. The annular groove has an "acutely-shaped" shoulder extending radially therewith, and which groove is longitudinally extensive. The clamp ring is arranged radially outwardly of the flange hub, and has a central inner opening to permit its disposition about that hub. A plurality of radially inwardly stepped tabs is evenly spaced about the inner peripherally of the central opening of the clamp ring. Each spaced tab includes a support surface arranged perpendicular to the axis of rotation of the drum. A pair of generally "C"-shaped split rings, each ring extending through an arc of about 180 degrees, are arranged in an opposed manner within the central opening of the clamp ring. Each split ring has an innermost, sharp, arcuate, peripheral shoulder which mates within the "acutely-shaped" groove arranged at the spaced distance from the uppermost edge of the annular housing. The inner periphery of the sharp, angular segment of the split ring mates within the angled shoulder of that groove, so as to support and be radially restrainably engaged therewith, permitting longitudinally directed movement in the longitudinally extensive grove, in a direction corresponding to the longitudinal axis of the drum. Each split ring has a pair of spaced-apart dimples on its lowermost side. Each dimple is in corresponding longitudinal alignment with the support surface on the radially inwardly extending tabs on each of the clamp rings. A compressive spring is arranged between each dimple and each respective support pad on each of the clamp rings, so as to provide a uniform longitudinally or downwardly (axially) directed bias on the clamp ring towards the uppermost flange on the drum. By virtue of the split ring being compressively engaged with respect to the hub permits the relative longitudinal motion therebetween.

The upper flange on the drum includes an annular, outwardly disposed generally co-axially extending wall portions which mate within sections of a corresponding channel on the lower-most side of the clamp ring. The clamp ring has generally axially extending wall sections that are directed downwardly from the lower side of the clamp ring and are arranged to mate within gaps of the aforementioned upperwardly extending wall portions on the upper flange of the drum. The wall portions of the upper flange and the wall sections of the clamp ring comprise the radially innermost surface onto which the tail of the line or halyard may be wrapped as it comes from the drum.

The peeler bar includes a radially outwardly extending arm, and an "L"-shaped finger extending downwardly and in parallel alignment with the axis of the rotation of the drum. The downwardly extending finger has a radially inwardly directed tab which is disposed between the outermost edges of the clamp ring and upper flange, to wedge or sweep out any line squeezed therebetween. The downwardly directed radially outer surface of the clamp ring and the upwardly directed radially outermost surface of the upper flange have roughened or abrasive surfaces so as to provide a frictional engagement with any line or halyard wrapped therebetween.

In operation of the marine winch utilizing the tension adjustable clamp ring, a line or halyard is wrapped between the clamp ring and uppermost flange of the drum, the clamp ring permitting a biased downwardly directed force against that line or halyard, by virtue of the compressive springs acting upon the dimples between the split rings engaged within the hub, and those support surfaces disposed radially inwardly on the clamp ring. Thus that annular volume defined by the inner surface of the clamp ring and the upper flange is longitudinally expandable, depending upon the diameter of any line or halyard arranged therebetween. The gripping force imposed upon the line disposed within those surfaces of the clamp ring and the upper flange of the drum is thus limited by the compressive force of the springs between the split ring and the clamp ring. If the tension on the line or the halyard exceeds for example 50 lbs., the wedging and frictional engagement force forward by the clamp ring and the upper surface of the upper flange is overcome, by virtue of the compression limits on the compressive spring arranged therebetween. The line or halyard therefore, is permitted to be released by any holder of that line and is likely not to be pulled within such clamp ring and upper flange location. The pinched surface therefore will not allow tension in the line to exceed for example 50 lbs. Such rough pinched surface and spring force limits that tension in the line or lets that line slip relative to the drum.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
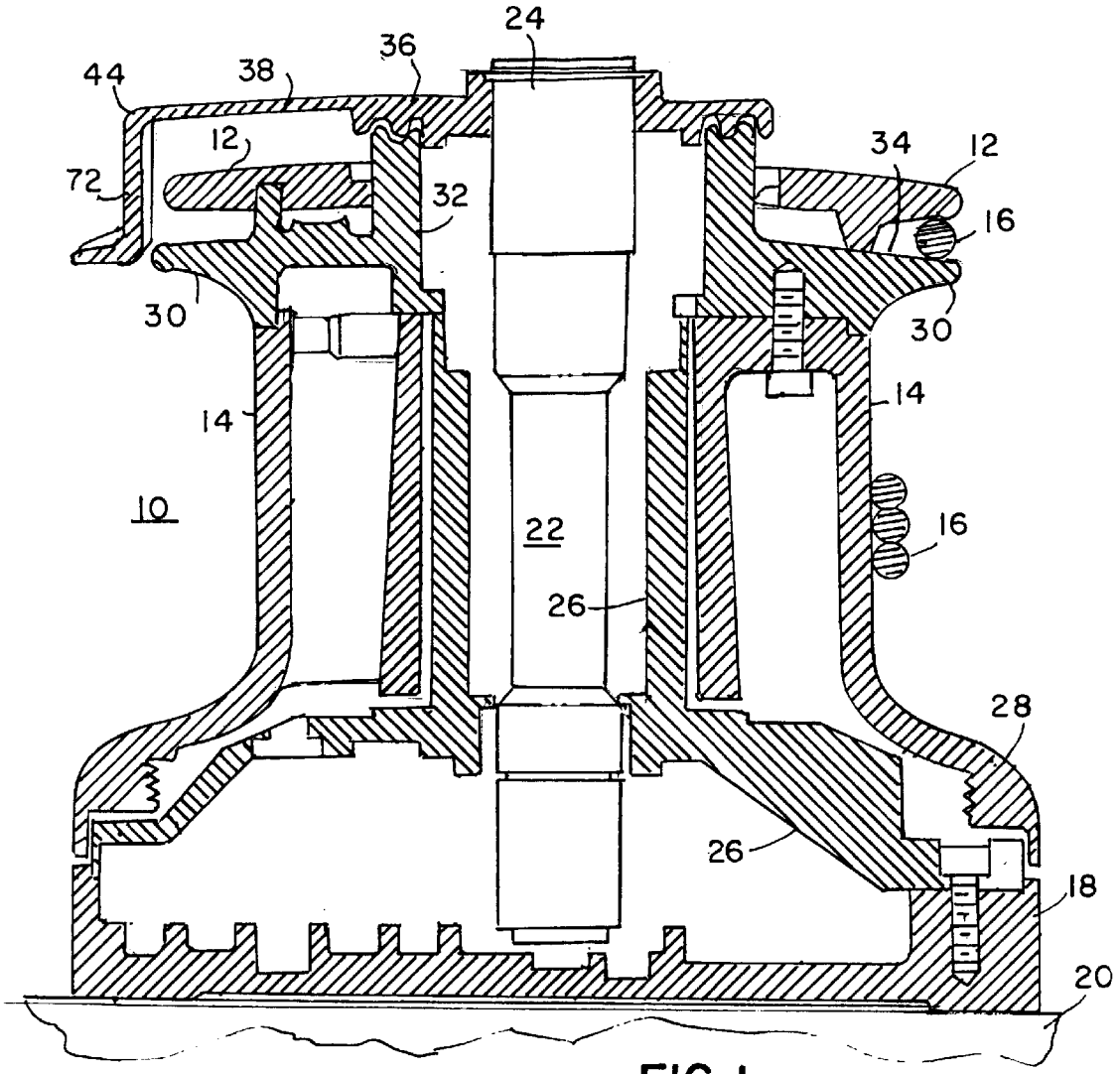
FIG. 1 is a side elevational view, in section, of a marine winch constructed according to the principles of the present invention.

Referring now to the drawings in detail, and particularly to FIG. 1, there is shown the present invention which involves a marine winch 10 with a tension limiting clamp ring 12 arranged at the top end of a drum 14, so as to put a limit on the tension of a line or halyard 16 being gripped thereat, by a sailor holding the tail end of that line or halyard. The marine winch 10 comprises a generally circular base plate 18, which base plate 18 is typically fixed to a deck or other exposed surface 20 of a sailboat. A vertically disposed driveshaft 22 is rotatably supported at a central location on the base plate 18. The driveshaft 22 has an upper end 24 into which a handle (not shown) may be affixed to rotate the driveshaft 22 and drum 14. A plurality of planetary gears (not shown) is arranged circumferentially about the driveshaft 22. The gears are enclosed and the driveshaft is engaged within an inner housing 26. The inner housing 26 is generally circular and is fixedly attached at its rim-like base to the base plate 18. The housing 26 includes an internal hollow shaft disposed annularly about the driveshaft 22. The generally cylindrically shaped drum14 is rotatably supported about the driveshaft 22. The drum 14 has a bottom flange 28 disposed adjacent to the periphery of the lower portion of the housing 26 and base plate 18. The drum 14 has an upper flange 30 fixedly attached thereto. The upper and lower flanges 28 and 30 define the upper and lower boundaries for a line or halyard 16 to be wrapped about the drum 14.

Figure 2:
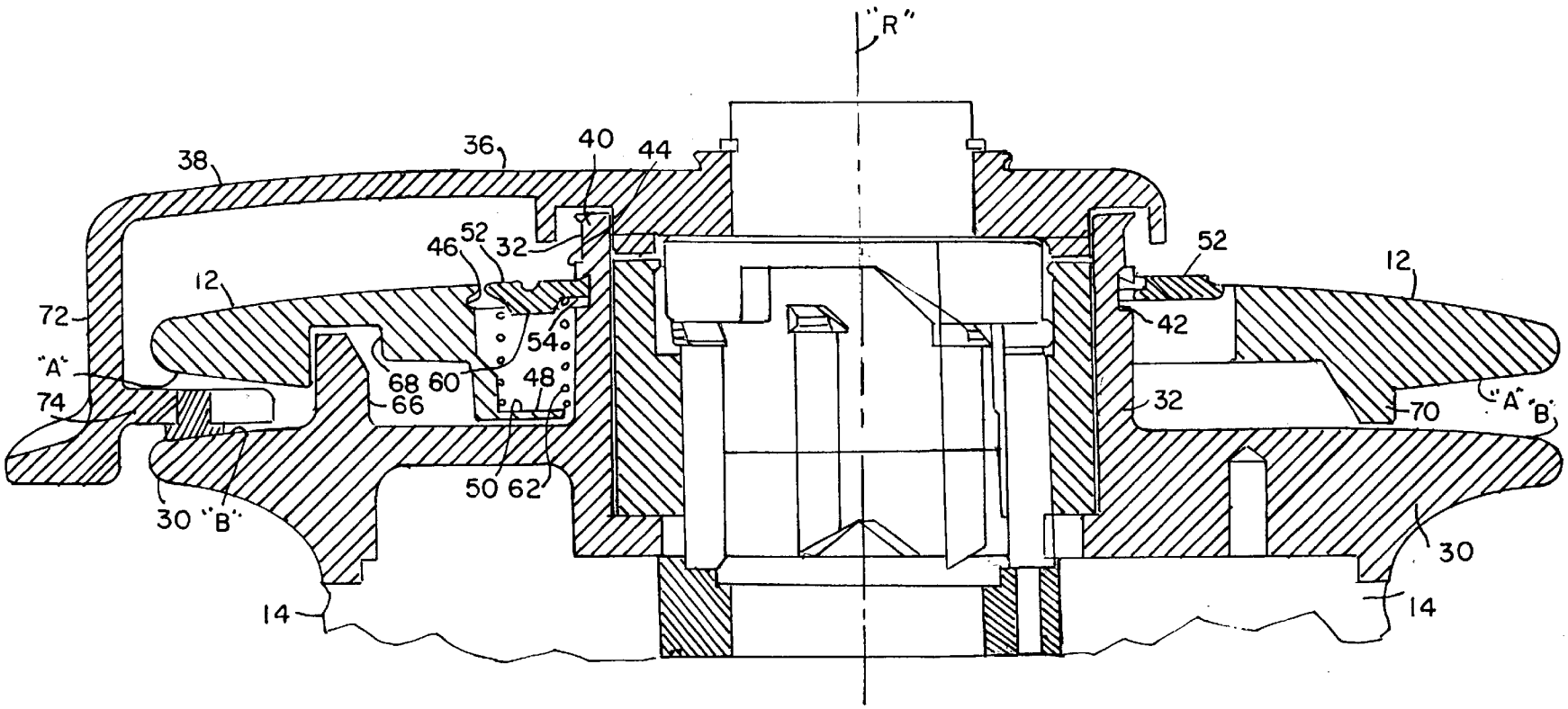
FIG. 2 is a side elevational view of the uppermost end of a marine winch generally similar to that shown in FIG. 1.
Figure 3B:
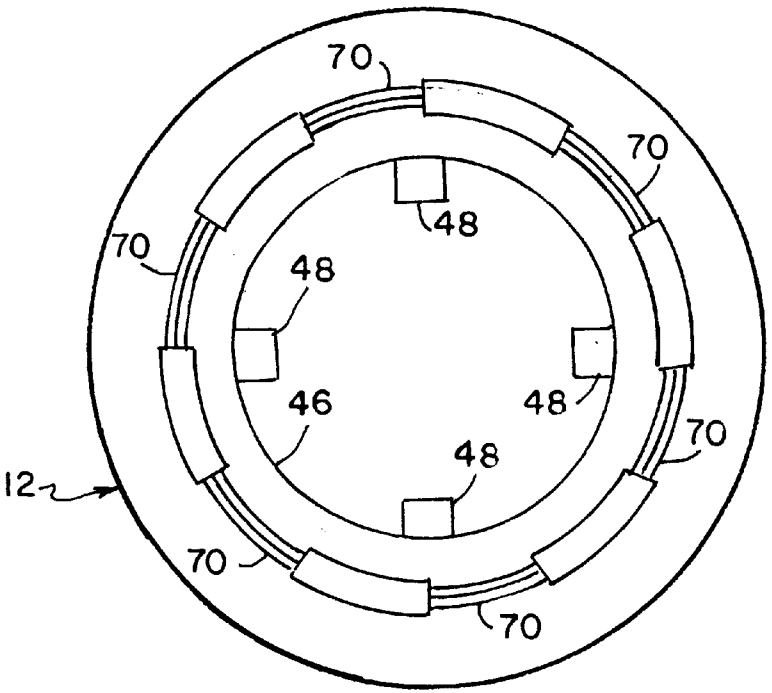
FIG. 3*a* and FIG. 3*b* is a plan views of the top and bottom of the clamp ring shown in FIGS. 1 and 2.
Figure 3A:
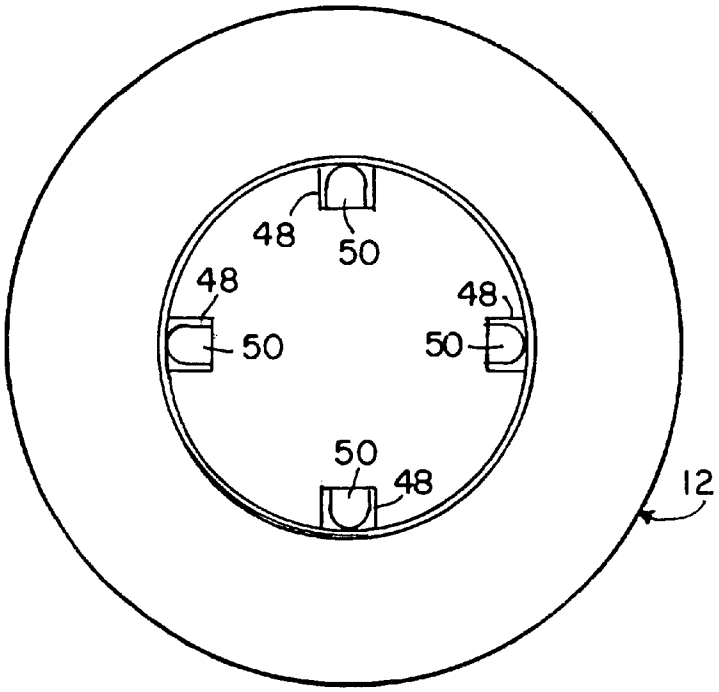
Figure 6:
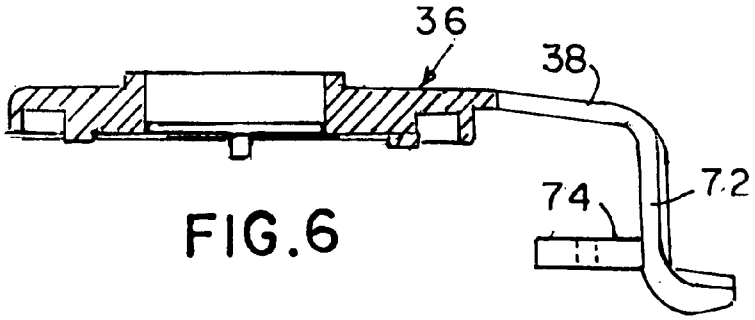
FIG. 6 is a view taken along the line 6—6 of FIG. 5.
Figure 5:
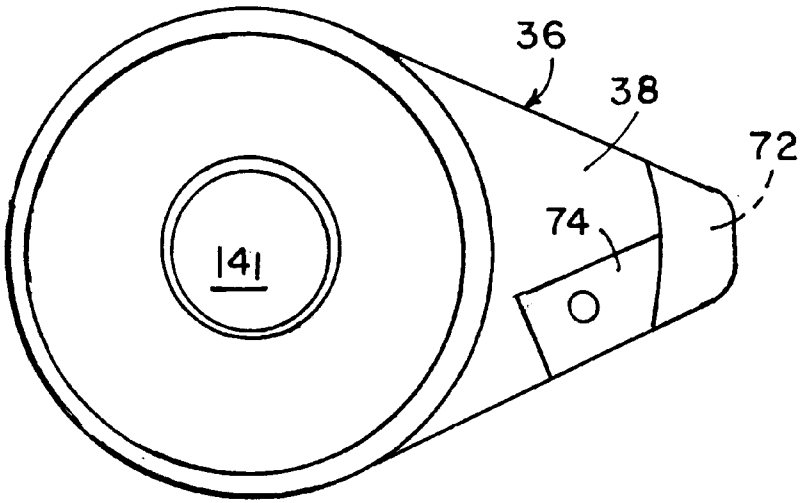
FIG. 5 is a plan view of the bottom side of the peeler bar shown in transverse section in FIG. 1.
Figure 4:
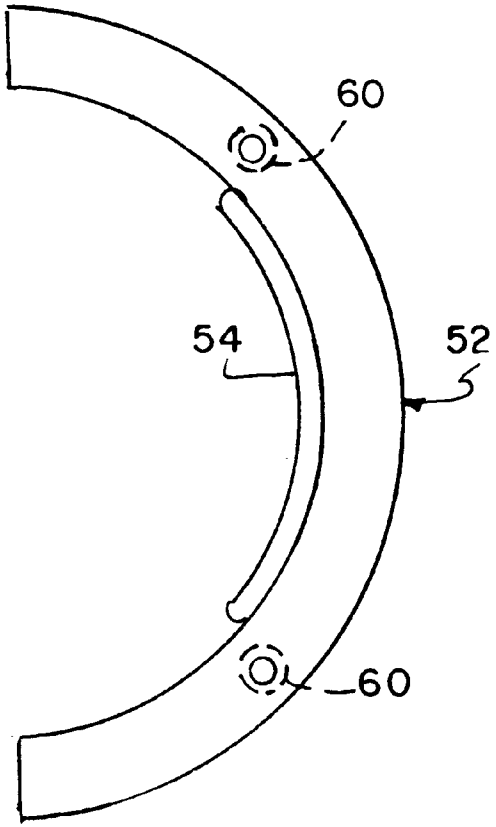
FIG. 4 is a plan view of the split ring, which is shown in transverse section, in FIG. 2.

The clamp ring 12, shown more clearly in FIG. 2, is disposed about an annular hub member 32 that comprises the radially inner portion of the upper flange 30. The clamp ring 12 is arranged to be co-axially movable with respect to and is supported on the upper surface 34 of the upper flange 30. A peeler or stripper bar 36, shown in cross section in FIGS. 2 and 6, and in a bottom view, in FIG. 5, is arranged on the uppermost end of the driveshaft 22, and has radially extended finger 38 over which the line or halyard 16 is fed after wrapping of the line about the drum 14. The flange hub 32 or annular housing portion of the upper flange 30 has an uppermost end 40 over which the peeler bar 36 is rotatably supported. The hub 32 of the upper flange 30 has an annular groove 42 arranged at a spaced distance from its uppermost end 40. The annular groove 42 has an "acutely-shaped" shoulder 44 extending radially therewith, and which groove 42 is longitudinally extensive. The clamp ring 12 is arranged radially outwardly of the flange hub 32, and has a central inner opening 46 to permit its disposition about that hub 32. A plurality of radially inwardly stepped tabs 48 is evenly spaced about the inner peripherally of the central opening 46 of the clamp ring 12. Each spaced tab 48 includes a support surface 50 arranged perpendicular to the axis of rotation "R" of the drum 14 . A pair of generally "C"-shaped split rings 52, (one of which is shown in FIG. 4), (each ring 52 extending through an arc of about 180 degrees), are arranged in an opposed manner within the central opening 46 of the clamp ring 12, as shown in FIG. 2. Each split ring 52 has an innermost, sharp, arcuate, peripheral shoulder 54 which mates within the "acutely-shaped" cut 44 of the groove 42 arranged at the spaced distance from the uppermost end 40 of the hub 32. The inner peripheral shoulder of the sharp, angular segment 42 of the split ring 52 mates within the angled cut shoulder 44 of that groove 42, so as to support and be radially restrainably engaged therewith, permitting longitudinally directed movement in the longitudinally extensive groove 42, as may be seen in FIG. 2, in a direction corresponding to the longitudinal axis "R" of the drum 14. Each split ring 52 has a pair of spaced-apart dimples 60 on its lowermost side, as may be seen in FIG. 2 2 and 4. Each dimple 60 is in corresponding longitudinal alignment with the support surface 50 on the radially inwardly extending tabs 48 on the clamp ring 12. A compressive spring 62 is arranged between each dimple 60 and each respective support pad 48 on the clamp ring 12, so as to provide a uniform longitudinally or downwardly (axially) directed bias on the clamp ring 12 towards the uppermost flange 30 on the drum 14. By virtue of the split ring 52 being compressively engaged with respect to the hub 32 permits the relative longitudinal motion therebetween.

The upper flange 30 on the drum 14 includes annular, outwardly disposed generally co-axially extending wall portions 66 which mate within sections of a corresponding channel 68 on the lower-most side of the clamp ring 12. The clamp ring 12 has several generally axially extending wall sections 70 that are directed downwardly from the lower side of the clamp ring 12 and are arranged to mate within the gaps between the aforementioned upwardly extending wall portions 66 on the upper flange 30 of the drum 14. The wall portions 66 of the upper flange 30 and the wall sections 70 of the clamp ring 12 comprise the radially innermost surface onto which the tail of the line or halyard 16 may be wrapped as it comes from the drum 14.

The peeler bar 36 includes a radially outwardly extending arm 38, and an "L"-shaped finger 72 extending downwardly and in parallel alignment with the axis of the rotation "R" of the drum 14. The downwardly extending finger 72 has a radially inwardly directed tab 74 which is disposed between the outermost edges of the clamp ring 12 and upper flange 30, to wedge out any line 16 squeezed therebetween. The downwardly directed radially outer surface "A" of the clamp ring 12 and the upwardly directed radially outermost surface "B" of the upper flange 30 have roughened or abrasive surfaces so as to provide a frictional engagement with any line or halyard 16 wrapped therebetween.

In operation of the marine winch 10 utilizing the tension adjustable clamp ring 12, a line or halyard 16 is wrapped between the clamp ring 12 and the uppermost flange 30 of the drum 14, the clamp ring 12 permitting a biased downwardly directed force against that line or halyard 16, by virtue of the compressive springs 62 acting upon the dimples 60 between the split rings 52 engaged within the hub 32, and those support surfaces 50 disposed on the radially inwardly directed tabs 48 on the clamp ring 12. Thus that annular volume defined by the inner surfaces "A" and "B" of the clamp ring 12 and the upper flange 30 is longitudinally expandable, depending upon the diameter of any line or halyard 16 arranged therebetween. The gripping force imposed upon the line 16 disposed within those surfaces "A" and "B" of the clamp ring 12 and the upper flange 30 of the drum 14 is thus limited by the compressive force of the springs 62 between the split ring 52 and the clamp ring 12. If the tension on the line or the halyard 16 exceeds for example 50 lbs., the wedging and frictional engagement force forward by the clamp ring 12 and the upper surface of the upper flange 30 is overcome, by virtue of the compression limits on the compressive spring 62 arranged therebetween. The line or halyard 16 therefore, is permitted to be released by any holder of that line 16 and is likely not to be pulled within such clamp ring 12 and upper flange 30 location. The pinch surfaces "A" and "B" therefore will not allow tension in the line 16 to exceed for example 50 lbs. Such rough pinch surfaces "A" and "B" and spring force limits that tension in the line, or lets that line 16 slip relative to the drum 14.

I claim:

1. A marine winch having a tension limiting clamp ring thereon, to permit the safe release of a line or halyard when forces become too great thereon, said winch comprising:

a winch base for attachment to a boat;

a central driveshaft supported on said base, said driveshaft having a lower end and an upper end;

a drum disposed about said driveshaft, said drum having an upper flange and a lower flange thereon, said drum arranged to receive a line thereabout, said upper flange having an inner hub disposed about said upper end of said driveshaft;

a clamp ring arranged about said hub, said clamp ring and said upper flange having opposed outer annular surfaces thereon arranged to receive a line, said clamp ring being movable with respect to said upper flange and said hub to provide a biasing force on a line disposed between said outer annular surfaces; said hub and said clamp ring having an array of compressive springs arranged therebetween, to effect said biasing force onto said clamp ring and onto the line between said opposed outer annular surfaces.

2. The marine winch as recited in claim 1, including:

a groove arranged in an outer surface of said hub, to receive an arrangement of split rings; and a plurality of tabs arranged on said clamp ring, said springs being supported between said tabs and said split rings to provide said biasing force therebetween.

3. The marine winch as recited in claim 2, wherein said groove in said hub has an acutely shaped shoulder cut therein, said split rings being arranged on said shoulder in a secure manner so as to permit said springs to compress against said clamp ring.

4. The marine winch as recited in claim 3, wherein said upper flange and said clamp ring have adjacent interdigitated wall portions defining an annular innermost border for the line received between said outer annular surfaces of said flange and said clamp ring.

5. The marine winch as recited in claim 4, wherein said split rings have a dimple arranged to receive an upper end of said compressive springs, to keep them from shifting out of alignment.

6. The marine winch as recited in claim 5, wherein said groove in said hub is longitudinally extensive so as to permit receipt and movement of said split rings therein.

7. The marine winch as recited in claim 6, wherein said clamp ring has a channel arranged on a lower side thereof, to engage a wall portion of said upper flange therewithin, ensuring integrity of said inner border for a line received between said outer surfaces of said upper flange and said clamp ring.

8. The marine winch as recited in claim 7, including a peeler bar having an inwardly directed tab on a finger thereof, said tab arranged to sweep between said clamp ring and said flange to dislodge the line supported therebetween as said upper flange and said clamp ring rotate about an axis of rotation with said drum.

9. The marine winch as recited in claim 8, wherein each of said split rings extend through an arc of about 180 degrees.

* * * * *